US005409215A

United States Patent [19]

You

[11] Patent Number: 5,409,215

[45] Date of Patent: Apr. 25, 1995

[54] SHOCK-ABSORBING METAL GAME RACKET

[76] Inventor: Chin-San You, No. 6, Lane 477, Sec. 2, Feng-Shyn Rd., Feng Yuan City, Taichung Hsien, Taiwan, Prov. of China

[21] Appl. No.: 197,881

[22] Filed: Feb. 17, 1994

[51] Int. Cl.[6] ..... A63B 49/02

[52] U.S. Cl. ..... 273/73 G; 273/23 R; 273/73 H

[58] Field of Search ..... 273/73 R, 73 C, 73 G, 273/73 H

[56] References Cited

U.S. PATENT DOCUMENTS 5,120,136 3/1992 Chen ..... 273/73 C X
5,219,166 6/1993 Chang ..... 273/73 G X
5,263,712 11/1993 Lo ..... 273/73 G

FOREIGN PATENT DOCUMENTS 4102901 8/1992 Germany ..... 273/73 G
4272775 9/1992 Japan ..... 273/73 R

*Primary Examiner*—Raleigh W. Chiu
*Attorney, Agent, or Firm*—Browdy and Neimark

[57] ABSTRACT

A shock-absorbing metal game racket comprises a frame and a handle connected at one end thereof with a posterior end of the frame made of a metal-tube by bending. The frame has an annular head portion with two open ends from which two parallel shaft portions are formed such that the shaft portions extend respectively toward the handle, Each of the two shaft portions has an outer surface provided with an open slot of a predetermined length. The open slot is provided with a shock-absorbing member embedded thereinto for absorbing the shock wave coming from the head portion which has hit a ball.

10 Claims, 4 Drawing Sheets

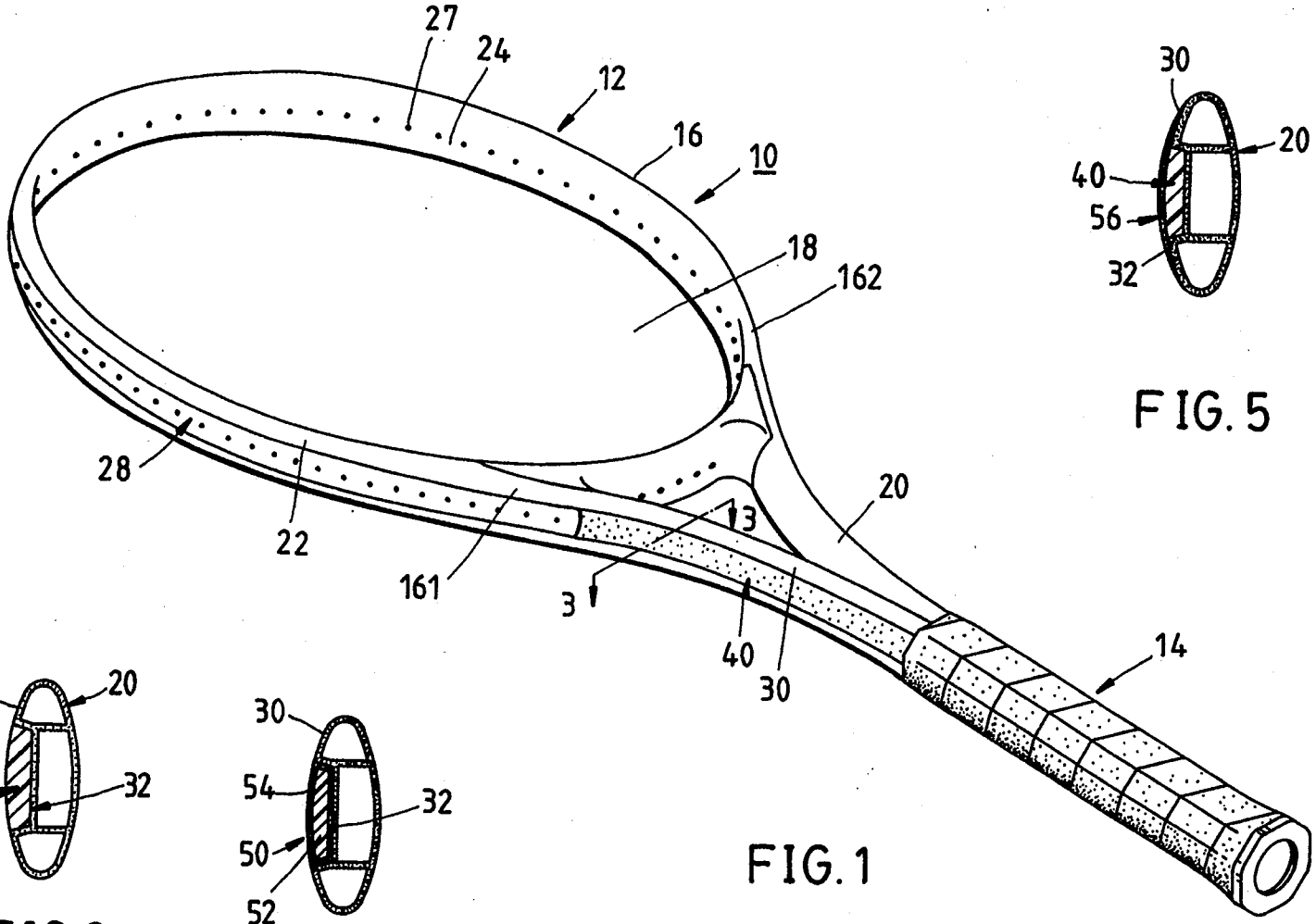
FIG. 1
FIG. 5
FIG. 4
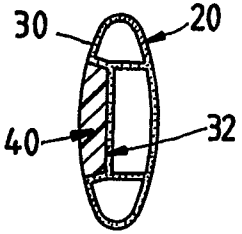
FIG. 3

SHOCK-ABSORBING METAL GAME RACKET

FIELD OF THE INVENTION

The present invention relates generally to a game racket, and more particularly to a metal game racket capable of absorbing shock.

BACKGROUND OF THE INVENTION

The U.S. Pat. No. 5,039,096 discloses a shock-absorbing game racket having a shaft which is provided circumferentially a plurality of grooves. Each of the grooves is covered with a shock-absorbing ribbon. Such a prior art game racket as described above is capable of attenuating the shock to a very limited extent in view of the fact that the grooves are distributed at intervals in the shaft and that the shock wave is interrupted at intervals instead of being reduced progressively. In addition, the cost of making such a prior art game racket as described above is relatively high because the shock-absorbing ribbons of different lengths are needed for covering the grooves of different lengths.

SUMMARY OF THE INVENTION

It is the primary objective of the present invention to provide a shock-absorbing metal game racket, which overcomes the shortcomings of the prior art shock-absorbing game racket described above.

The foregoing objective of the present invention is attained by the shock-absorbing metal game racket, which comprises a frame and a handle coupled with a posterior end of the frame made of a metal tube by bending. The frame has an annular head defining a ball-striking surface and two open ends located at one side of a longitudinal axis thereof. Two shaft portions extend from the two open ends toward the handle. The game racket of the present invention is characterized in that the shaft portions are provided respectively with an inner surface and an outer surface, which are substantially perpendicular to the ball-striking surface. The outer surface is provided with at least one open slot of a predetermined length and extending in the direction of the length of the shaft portion. The open slot is provided with a shock-absorbing member embedded thereinto.

The open slot of the shaft portions of the game racket of the present invention is continuous and provided therein with a shock-absorbing member. As a result, the shock wave transmitted from the frame to the shaft portions is attenuated continuously. The game racket of the present invention is therefore more effective in reducing the shock wave. In addition, all open slots are similar in dimension and can be provided with the shock-absorbing members similar in dimension, thereby resulting in reduction in the production cost.

BRIEF DESCRIPTION OF THE DRAWINGS

FIG. 1 shows a perspective view of a first preferred embodiment of the present invention.

FIG. 3 shows a sectional view of a portion taken along the line 3—3 as shown in FIG. 1.

FIG. 4 shows a sectional view of a portion of a second preferred embodiment of the present invention, with the portion being taken in the direction similar to the line 3—3 as shown in FIG. 1.

FIG. 5 shows a sectional view of a portion of a third preferred embodiment of the present invention, with the portion being taken in the direction similar to the line 3—3 as shown in FIG. 1.

DETAILED DESCRIPTION OF THE INVENTION

Figure 2:
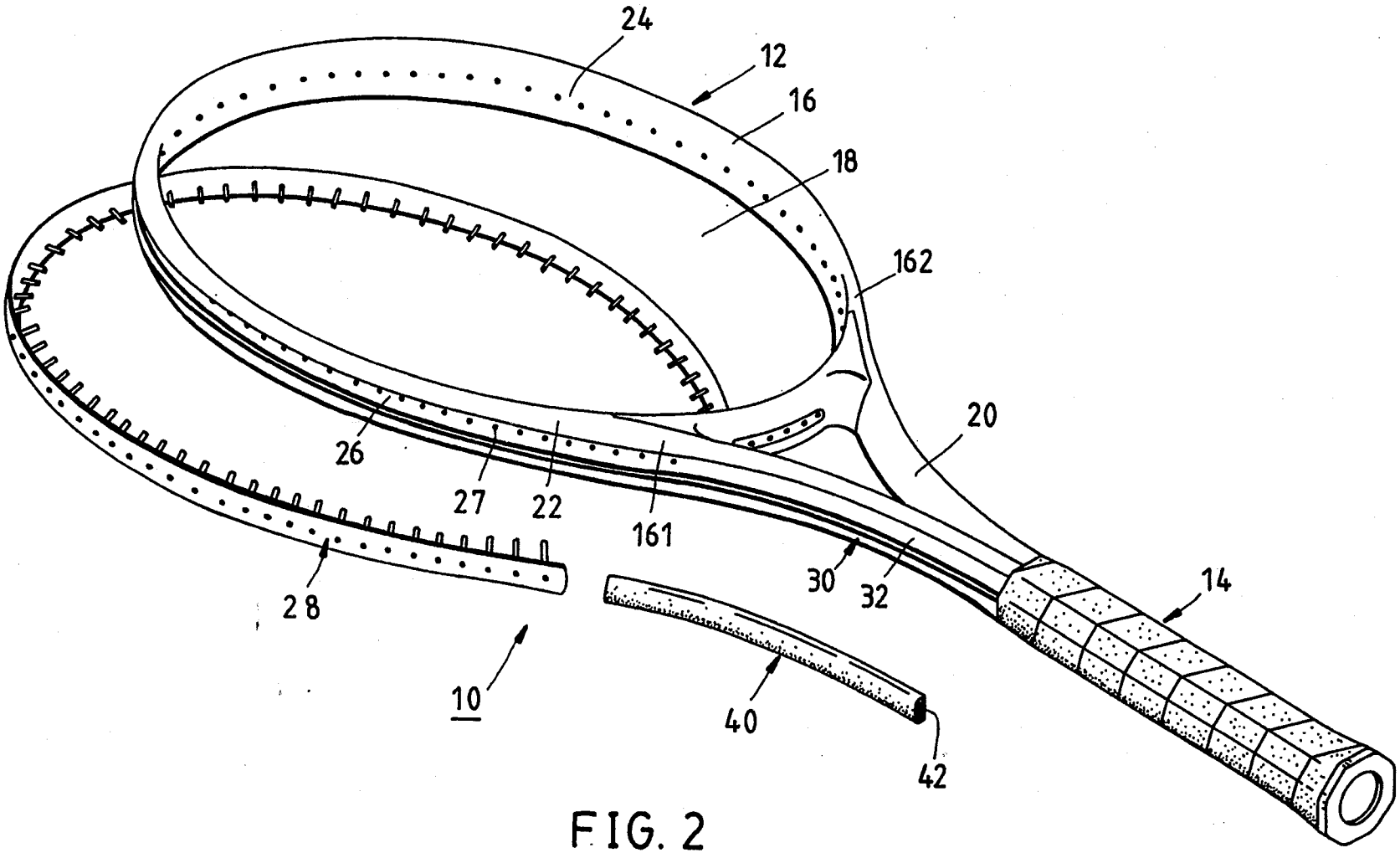
FIG. 2 shows a partial exploded view of the first preferred embodiment of the present invention.

Referring to FIGS. 1–3, a shock-absorbing metal game racket 10 of the first preferred embodiment of the present invention is shown to comprise a frame 12 and a handle 14 connected with a posterior end of the frame 12. The frame 12 is made of an aluminium alloy having a shuttle-shaped cross section and is provided with an annular head 16 defining a ball-hitting surface 18. The head 16 is provided at one end of the longitudinal axis thereof with two open ends 161 and 162 from which two shaft portions 20 extend in parallel to the longitudinal axis of the head 16 toward the handle 14.

The head 16 has an outer surface 22 and an inner surface 24, which are substantially perpendicular to the ball-hitting surface 18. The outer surface 22 is provided with a first open slot 26 having at the bottom thereof a plurality of string holes 27 reaching the inner surface 24. The first open slot 26 is intended to receive a string protecting casing 28.

Each of the two shaft portions 20 has an outer surface 30 extending from the outer surface 22 of the head 16. The outer surface 30 is provided with a second open slot 32 extending from the first open slot 26 to reach the anterior end of the handle 14. The second open slot 32 is provided therein with a shock-absorbing ribbon 40 of a polyurethane foam material and similar in length to the second open slot 32. It must be noted here that the frame 12 of the present invention is made of an aluminium alloy tube by extrusion, and that the first open slot 26 and the second open slot 32 are made simultaneously with the frame 12. In addition, the shock-absorbing ribbon 40 has an inner face 42 which is coated with an adhesive compatible with the surface treating agent of the aluminium alloy tube of which the frame 12 is made. As a result, the shock-absorbing ribbon 40 can be held securely in the second open slot 32, thanks to the adhesive coating of the inner side face 42.

As shown in FIGS. 4 and 5, another preferred embodiment of the present invention is provided with a shock-absorbing ribbon 50 having a main body 52 and an outer layer 54. The main body 52 is made of a polyurethane foam material while the outer layer 54 is made of a fiber-reinforced plastic material. For example, the outer layer 54 can be made of a plurality of long fiber fabric sheets which are preimpregnated in resin and are stacked windingly and orderly on the main body 52. The outer layer 54 serves to reinforce the strength of the shock-absorbing ribbon 50 and to make the shock-absorbing ribbon 50 join securely with the second open slot 32. It is suggested that the outer side surface 30 of the shaft portion 20 may be provided lengthwise with an outer layer 56 having a width greater than the width of the second open slot 32. It is preferable that the outer layer 56 is formed of a plurality of long fiber fabric sheets which are preimpregnated with a thermosetting resin and are stacked orderly.

Figures 6, 7, 8:
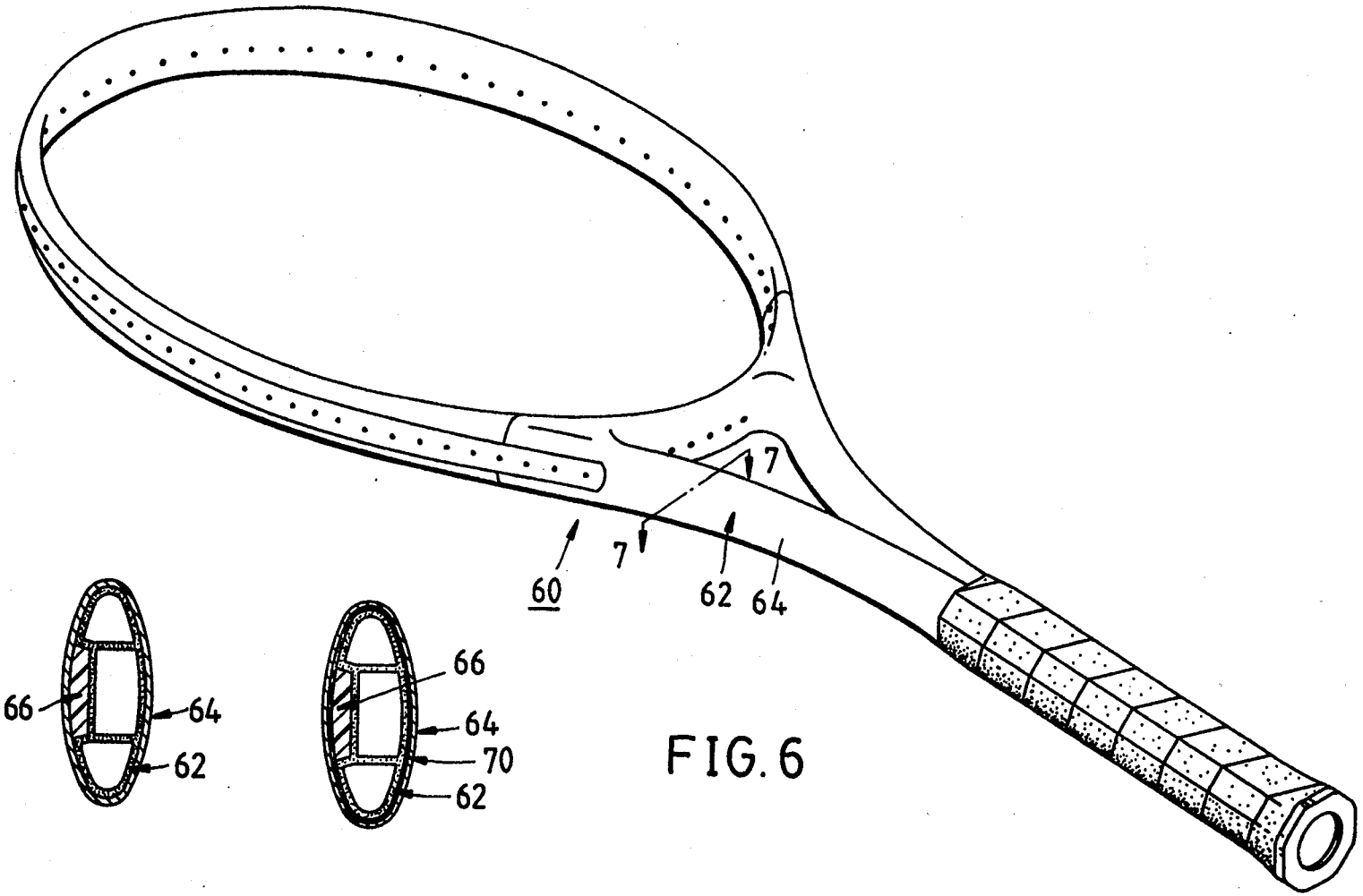
FIG. 6 shows a perspective view of a fourth preferred embodiment of the present invention.
FIG. 7 shows a sectional view of a portion taken along the line 7—7 as shown in FIG. 6.
FIG. 8 shows a sectional view of a portion of a fifth preferred embodiment of the present invention, with the portion being taken in the direction similar to the line 7—7 as shown in FIG. 6.

As shown in FIGS. 6 and 7, a shock-absorbing metal tennis racket 60 of still another preferred embodiment of the present invention is provided additionally with a surface treating layer 64 wrapping each of the two shaft portions 62. The surface treating layer 64 is formed of a polymer or a composite material containing 20% of epoxy resin, 30%. of poly carbonic resin, 50% of polyurethane, and an appropriate quantity of a hardener. The thickness of the surface treating layer 64 may be adjusted in accordance with the requirements of the players. The surface treating layer 64 serves to prevent the shock-absorbing ribbon 66 from becoming detached and to make the surface of the shaft portion 62 appear seamless.

As shown in FIG. 8, each shaft portion 62 is covered with a bridging layer 70 before the surface treating layer 64 is formed on the outer surface of each shaft portion 64. The bridging layer 70 is made of a fiber-reinforced plastic material. For example, a plurality of long fiber fabric sheets preimpregnated with epoxy resin are wound orderly on the same surface of each shaft portion 62 to form the bridging layer 70, which is then covered with the surface treating layer 64. The bridging layer 70 serves to enhance the binding power between the surface treating layer 64 and the shaft portion 62.

Figure 9:
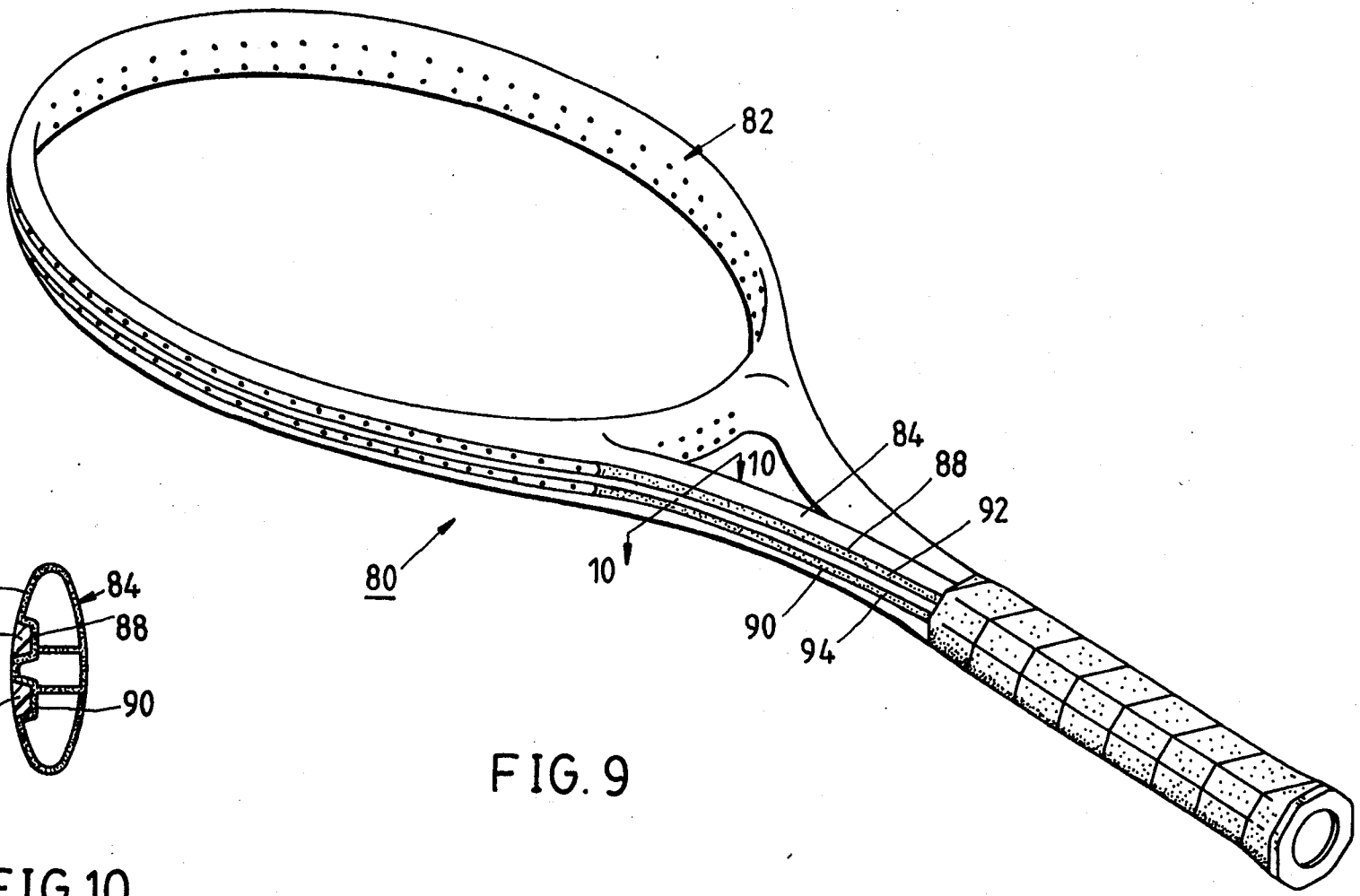
FIG. 9 shows a perspective view of a sixth preferred embodiment of the present invention.
Figure 10:
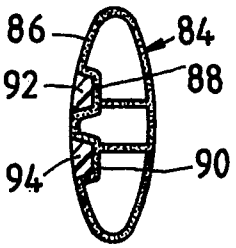
FIG. 10 shows a sectional view of a portion taken along the line 10—10 as shown in FIG. 9.

A shock-absorbing metal game racket 80 of still another preferred embodiment of the present invention is shown in FIGS. 9 and 10. The game racket 80 has a frame 82 made of an aluminium alloy tube by bending. The aluminium alloy tube is provided in the outer surface thereof with two parallel slots at the time when the aluminium alloy tube is formed. As a result, each shaft portion 84 of the frame 82 is provided in the outer side surface 86 thereof with two parallel open slots 88 and 90, which are provided therein with shock-absorbing ribbons 92 and 94 respectively.

The present invention has inherent advantages over the prior art game racket in that the shock wave transmitted from the head to each of the two shaft portions of the present invention is absorbed effectively and continuously by the shock-absorbing ribbons embedded in the outer surface of each of the two shaft portions, and that the cost of making the present invention is relatively lower, thanks to the shock-absorbing ribbons which are of uniform dimension and can be produced at a lower cost, and further that the process of combining various component parts of the present invention is simpler and faster.

What is claimed is:

1. A shock-absorbing metal game racket comprising a frame and a handle connected at one end thereof with a posterior end of said frame made of a metal tube by bending, said frame having an annular head portion defining a ball-hitting surface of said frame, said head portion being provided at one end of a longitudinal axis thereof with two open ends symmetrical to each other and extending toward said handle to form two shaft portions parallel to each other; wherein each of said two shaft portions comprises an inner surface and an outer surface, which are substantially perpendicular to said ball-hitting surface, with said outer surface being provided with at least one open slot of a predetermined length and extending in the direction of the length of said each shaft portion, said open slot being provided with at least one shock-absorbing means embedded thereinto, wherein said outer side surface of each of said two shaft portions is covered with an outer layer made of a fiber-reinforced plastic material and adhered thereto, said outer layer having a width greater than a width of said open slot, said outer layer extending in the direction of the length of said shaft portion.

2. The shock-absorbing metal game racket in accordance with claim 1 wherein said shock-absorbing means is of a ribbon like construction and made of a plastic foam material.

3. The shock-absorbing metal game racket in accordance with claim 1 wherein said shock-absorbing means comprises a ribbon-shaped main body made of a plastic foam material and covered thereon with at least one outer layer of a fiber-reinforced plastic material.

4. The shock-absorbing metal game racket in accordance with claim 1 wherein said outer layer is formed of a predetermined number of long fiber fabric sheets which are preimpregnated with a thermosetting resin and are stacked together in series.

5. The shock-absorbing metal game racket in accordance with claim 1 further comprising a surface treating layer covering peripherally each of said two shaft portions after said open slot is provided with said shock-absorbing means.

6. The shock-absorbing metal game racket in accordance with claim 5 wherein said surface treating layer is made of a polymer.

7. The shock-absorbing metal game racket in accordance with claim 5 further comprising a bridging layer located between a peripheral surface of each of said two shaft portions and said surface treating layer.

8. The shock-absorbing metal game racket in accordance with claim 7 wherein said bridging layer is formed of a predetermined number of long fiber fabric sheets which are preimpregnated with a thermosetting resin and are stacked windingly and orderly.

9. The shock-absorbing metal game racket in accordance with claim 1 wherein said open slot extends from each of said two open ends of said head portion to reach an anterior end of said handle.

10. The shock-absorbing metal game racket in accordance with claim 9 wherein said head portion has an outer surface which is substantially perpendicular to said ball-hitting surface and is provided with at least another open slot having one end that is connected with one end of said open slot of each of said two shaft portions.

* * * * *